US009708700B2

(12) United States Patent
Kin et al.

(10) Patent No.: US 9,708,700 B2
(45) Date of Patent: *Jul. 18, 2017

(54) MAGNESIUM-LITHIUM ALLOY, ROLLED MATERIAL, FORMED ARTICLE, AND PROCESS FOR PRODUCING SAME

(75) Inventors: Kenki Kin, Settsu (JP); Takeki Matsumura, Settsu (JP); Shinji Namba, Settsu (JP); Shinichi Umino, Settsu (JP); Takayuki Goto, Kobe (JP); Yuji Tanibuchi, Kobe (JP); Yukihiro Yokoyama, Kobe (JP)

(73) Assignee: SANTOKU CORPORATION, Kobe-shi, Hyogo (JP)

( * ) Notice: Subject to any disclaimer, the term of this patent is extended or adjusted under 35 U.S.C. 154(b) by 1082 days.

This patent is subject to a terminal disclaimer.

(21) Appl. No.: 13/395,269

(22) PCT Filed: Dec. 25, 2009

(86) PCT No.: PCT/JP2009/071655

§ 371 (c)(1), (2), (4) Date: May 24, 2012

(87) PCT Pub. No.: WO2011/030474

PCT Pub. Date: Mar. 17, 2011

(65) Prior Publication Data

US 2012/0222784 A1 Sep. 6, 2012

(30) Foreign Application Priority Data

Sep. 11, 2009 (JP) ..... 2009-211133

(51) Int. Cl.

| | |
|---|---|
| ***C22C 23/00*** | (2006.01) |
| ***C22F 1/06*** | (2006.01) |
| ***C23C 22/34*** | (2006.01) |
| ***C23C 22/78*** | (2006.01) |
| ***C23G 1/12*** | (2006.01) |

(52) U.S. Cl.

CPC ..... *C22F 1/06* (2013.01); *C22C 23/00* (2013.01); *C23C 22/34* (2013.01); *C23C 22/78* (2013.01); *C23G 1/12* (2013.01)

(58) Field of Classification Search

CPC ..... C22C 23/00; C22C 23/02; C22C 23/04; C22C 23/06; C22F 1/06; C23C 22/06; C23C 22/07; C23C 22/24; C23C 22/30; C23C 22/46; C23C 22/48; C23C 22/68; C23G 1/12

USPC ..... 420/407, 402

See application file for complete search history.

(56) References Cited

U.S. PATENT DOCUMENTS

2003/0084968 A1* 5/2003 Bronfin ..... C22C 23/02 148/420

FOREIGN PATENT DOCUMENTS

| | | | |
|---|---|---|---|
| JP | 9-41066 | A | 2/1997 |
| JP | 11-279675 | A | 10/1999 |
| JP | 2000-87199 | A | 3/2000 |
| JP | 2000-282165 | A | 10/2000 |
| JP | 2001-40445 | A | 2/2001 |
| JP | 2002-348646 | A | 12/2002 |
| WO | WO 2009/113601 | A1 | 9/2009 |

OTHER PUBLICATIONS

Liu et al., "Effects of Nd on microstructure and mechanical properties of as-cast LA141 alloys," Materials Science and Engineering: A, 2008, vol. 487, pp. 347-351.*

Davis, J. R. "Approximate Equivalent Hardness Nos. For Wrought Coppers." Copper and Copper Alloys. Materials Park, OH: ASM International, 2001.*

G.S. Song, Staiger, M., and M. Kral. "Enhancement of the Properties of Mg—Li Alloys by Small Alloying Additions." Magnesium Technology 2003. San Diego: Wiley, 2003. 77-79.*

Ghali, E., W. Dietzel, and K. Kainer. "General and Localized Corrosion of Magnesium Alloys: A Critical Review." Journal of Materials Engineering and Performance 13.1 (2004): 7-23.*

Cverna, Fran, and Sandy Dunigan. "Compositions of Magnesium Alloys." Worldwide Guide to Equivalent Nonferrous Metals and Alloys. 4th ed. Materials Park, OH: ASM International, 2001.*

Crawford et al., "On the Transformation Characteristics of LA141A (Mg—Li—Al) Alloy," Journal of Materials Processing Technology, 1996, vol. 56, pp. 108-118.

Kazuo Matsuzawa et al., "Age-Hardening and Mechanical Properties of Mg—LiAl Alloys", Magnesium, 1989, pp. 10-16, vol. 18, No. 10.

Kazuo Matsuzawa et al., "The Effect of Assitional Element on the Age-Hardening Characteristics and Properties of Mg—Li Alloys" 1990, pp. 658-665, vol. 40, No. 9.

(Continued)

*Primary Examiner* — Jessee Roe
*Assistant Examiner* — Anthony Liang
(74) *Attorney, Agent, or Firm* — Sughrue Mion, PLLC

(57) ABSTRACT

The present invention provides a magnesium-lithium alloy having both corrosion resistance and cold workability balanced at high levels, a certain degree of tensile strength, and very light weight, as well as a rolled material and a formed article made of this alloy. The alloy of the invention contains not less than 10.5 mass % and not more than 16.0 mass % Li, not less than 0.50 mass % and not more than 1.50 mass % Al, and the balance of Mg, and has an average crystal grain size of not smaller than 5 μm and not larger than 40 μm, and a tensile strength of not lower than 150 MPa or a Vickers hardness (HV) of not lower than 50.

10 Claims, No Drawings

(56) References Cited

OTHER PUBLICATIONS

International Searching Authority, International Preliminary Report on Patentability in International Application No. PCT/JP2009/071655, dated Apr. 11, 2012.
European Patent Office; Communication dated Aug. 25, 2016, in counterpart European application No. 09849250.7.

* cited by examiner

MAGNESIUM-LITHIUM ALLOY, ROLLED MATERIAL, FORMED ARTICLE, AND PROCESS FOR PRODUCING SAME

CROSS REFERENCE TO RELATED APPLICATIONS

This application is a National Stage of International Application No. PCT/JP2009/071655 filed on Dec. 25, 2009, which claims priority from Japanese Patent Application No. 2009-211133 filed Sep. 11, 2009, the contents of all of which are incorporated herein by reference in their entirety.

FIELD OF ART

The present invention relates to magnesium-lithium alloys having excellent corrosion resistance and cold workability, rolled material, and formed articles thereof.

BACKGROUND ART

Recently, magnesium alloys, which are light in weight, have been attracting attention as structural metal materials. However, a typical magnesium alloy, AZ31 (3 mass % Al, 1 mass % Zn, and the balance of Mg), when rolled, has inferior cold workability, and cannot be pressed at lower than about 250° C. While magnesium takes the hcp crystal structure (α phase), magnesium-lithium alloys, which contain lithium, take a mixed phase of the hcp structure and the bcc structure (β phase) at a lithium content of 6 to 10.5 mass %, and a single β phase at a lithium content of 10.5 mass % and higher. As is known widely, slip in the α phase is limited, but the β phase has a number of slip systems. The cold workability of magnesium-lithium alloys improves as the lithium content increases so that the phase changes from the α/β mixed phase to the single β phase. However, since lithium is an electrochemically lower element, increase in the lithium content results in significant deterioration of the corrosion resistance of the alloys. On the other hand, alloys with a higher lithium content, such as LA141 (14 mass % Li, 1 mass % Al, and the balance of Mg), have also been developed. But these alloys are limited in use due to their insufficient corrosion resistance.

Patent Publication 1 teaches that magnesium-lithium alloys with a lithium content of not higher than 10.5 mass % and an iron impurity concentration of not higher than 50 ppm, have excellent corrosion resistance.

Patent Publication 2 teaches that magnesium-lithium alloys containing 6 to 10.5 mass % lithium and 4 to 9 mass % zinc have excellent strength and corrosion resistance at room temperature.

Patent Publication 3 discloses magnesium-lithium alloys containing 6 to 16 mass % lithium, which are suitable for cold-pressing.

Patent Publication 4 teaches that magnesium-lithium alloys having a lithium content of 10.5 to 40 mass % and an average crystal grain size of 3 to 30 μm, have excellent strength and press workability.

Non-Patent Publication 1 discloses effects of addition of Al, Zn, Cu, and Ag to magnesium-lithium alloys with a lithium content of 8 mass % and 13 mass % on their mechanical characteristics or corrosion resistance when subjected to processing or heat treatment.

In the prior art, however, no magnesium-lithium alloy has hitherto been obtained which contains not less than 10.5 mass % Li, is of the single β phase, and has both corrosion resistance and cold workability well balanced. No such single β phase magnesium-lithium alloy is known that has mechanical strength, e.g., a tensile strength of not lower than 150 MPa. For example, Patent Publication 4 discloses magnesium-lithium alloys having excellent strength and press workability, but the tensile strength of the alloys containing not less than 10.5 mass % Li disclosed in Examples is 131 MPa at most.

Patent Publication 4 also discloses a method for producing a magnesium-lithium alloy having excellent strength and press workability, including subjecting a magnesium-lithium alloy raw material ingot to hot rolling, cold rolling, and then heat-treating at 140 to 150° C. to recrystallize.

It is also disclosed that, in this method, the cold rolling at a higher reduction of 30 to 60% provides abetter rolled material than at a lower reduction of 20 to 25%. On the other hand, it is also disclosed that, in the same method, the heat treatment for recrystallization of the magnesium-lithium alloy at over 150° C. results in excess increase in the average crystal grain size of the obtained alloy, failing to obtain the desired effects. Thus, the summary of the teachings of Patent Publication 4 is that cold rolling at a higher reduction is preferred for better rolled materials, whereas the heat treatment for recrystallization should be done at 150° C. at most in order to obtain magnesium-lithium alloys with excellent strength and press workability.

Further, magnesium-lithium alloys as mentioned above are under discussion for use as a material composing the casing parts of various electrical instrument which are expected to be lightweight, such as mobile phones, notebook PCs, video cameras, and digital cameras. For such use, the alloys are required to have a low surface electrical resistivity for ensuring sufficient electromagnetic shielding ability and for providing ground to the substrates. Thus magnesium-lithium alloys with a low surface electrical resistivity are desired.

PRIOR ART PUBLICATIONS

Patent Publications

Patent Publication 1: JP-2000-282165-A
Patent Publication 2: JP-2001-40445-A
Patent Publication 3: JP-9-41066-A
Patent Publication 4: JP-11-279675-A

Non-Patent Publications

Non-Patent Publication 1: Keikinzoku (the Journal of Japan Institute of Light Metals) (1990), Vol. 40, No. 9, p 659-665

SUMMARY OF THE INVENTION

It is an object of the present invention to provide a very lightweight magnesium-lithium alloy which has both corrosion resistance and cold workability balanced at high levels, and has a certain degree of tensile strength, as well as a rolled material and a formed article made of the alloy, and a method of producing the alloy.

According to the present invention, there is provided a magnesium-lithium alloy comprising not less than 10.5 mass % and not more than 16.0 mass % Li, not less than 0.50 mass % and not more than 1.50 mass % Al, and the balance of Mg, wherein said alloy has an average crystal grain size of not smaller than 5 μm and not larger than 40 μm, and a tensile strength of not lower than 150 MPa (sometimes referred to as an Mg—Li alloy hereinbelow).

According to the present invention, there is also provided a Mg—Li alloy comprising not less than 10.5 mass % and not more than 16.0 mass % Li, not less than 0.50 mass % and not more than 1.50 mass % Al, and the balance of Mg, wherein said alloy has an average crystal grain size of not smaller than 5 μm and not larger than 40 μm, and a Vickers hardness (HV) of not lower than 50.

According to the present invention, there is further provided a method for producing the Mg—Li alloy mentioned above comprising the steps of:

(a) cooling and solidifying a raw material alloy melt into an alloy ingot, said raw material alloy melt comprising not less than 10.5 mass % and not more than 16.0 mass % Li, not less than 0.50 mass % and not more than 1.50 mass % Al, and the balance of Mg, (b) subjecting said alloy ingot to cold plastic working at a rolling reduction of not lower than 30%, and (c) annealing a plastic-processed alloy at 170 to lower than 250° C. for 10 minutes to 12 hours or at 250 to 300° C. for 10 seconds to 30 minutes.

According to the present invention, there is further provided a rolled material or a formed article made of the above-mentioned Mg—Li alloy.

The Mg—Li alloy of the present invention, irrespective of its Li content of not less than 10.5 mass %, has both corrosion resistance and cold workability, such as in pressing, balanced at high levels, and is excellently useful and contributes to weight saving due to its higher content of Li, which has a lower specific gravity than that of Mg.

PREFERRED EMBODIMENTS OF THE INVENTION

The present invention will now be explained in detail.

The Mg—Li alloy according to the present invention contains not less than 10.5 mass % and not more than 16.0 mass %, preferably not less than 13.0 mass % and not more than 15.0 mass % of Li, not less than 0.50 mass % and not more than 1.50 mass % of Al, and the balance of Mg.

At a Li content exceeding 16 mass %, the corrosion resistance and the strength of the alloy is too low to be practical. At an Al content in the above-mentioned range, mechanical strength of the alloy, such as tensile strength and Vickers hardness, is improved. At an Al content of less than 0.50 mass %, mechanical strength of the alloy cannot be improved sufficiently, whereas as at more than 1.50 mass %, cold workability of the alloy is remarkably deteriorated.

The Mg—Li alloy according to the present invention, having the Li content mentioned above, has a crystal structure of the single β phase, and is light in weight and excellent in cold workability.

The corrosion resistance of the Mg—Li alloy of the present invention is further improved by the addition of not less than 0.10 mass % and not more than 0.50 mass % of Ca. With Ca contained in the alloy, Mg and Ca forma compound, which induces nucleation upon recrystallization to cause formation of recrystallization texture with fine crystal grains. Corrosion of the Mg—Li alloy selectively proceeds within the crystal grains, while the grain boundaries impede the progress of corrosion. By formation of such grain boundaries, the corrosion resistance may be improved.

The Mg—Li alloy according to the present invention may optionally contain, in addition to the above-mentioned Al and Ca, one or more elements selected from the group consisting of Zn, Mn, Si, Zr, Ti, B, Y, and rare earth elements with atomic numbers 57 to 71, as long as the elements do not affect greatly the objective corrosion resistance and cold workability of the alloy. For example, addition of Zn further enhances cold workability, addition of Mn further enhances corrosion resistance, addition of Si lowers the viscosity of the alloy melt during production, addition of Zr improves strength, and addition of Ti improves fire resistance. Addition of Y improves strength at higher temperatures, but it should be noted that at a content of 1 mass % or more, strength and cold workability will be impaired. Addition of rare earth elements improves elongation and further enhances cold workability.

These optional components may preferably be contained at not less than 0 mass % and not more than 5.00 mass %. Higher contents add to the specific gravity of the alloy, which impairs the characteristics of the single β phase Mg—Li alloy. Thus the contents should preferably be minimum.

The Mg—Li alloy according to the present invention may contain Fe, Ni, and/or Cu as impurities each at not more than 0.005 mass %, respectively. By keeping the contents of impurities at such level, corrosion resistance is further enhanced.

The average crystal grain size of the Mg—Li alloy according to the present invention is not smaller than 5 μm and not larger than 40 μm. In particular, for excellent corrosion resistance, the average crystal grain size is preferably not smaller than 5 μm and not larger than 20 μm. If the average crystal grain size is smaller than 5 μm, a Mg—Li alloy having a tensile strength of not lower than 150 MPa or a Vickers hardness of not lower than 50 according to the present invention, which will be discussed later, can hardly be produced industrially, whereas if larger than 40 μm, the corrosion resistance is lowered.

The average crystal grain size as referred to herein may be determined by the linear analysis using an optical micrograph of a cross-sectional structure of the alloy. A sample etched with a 5% nitric acid ethanol solution is observed under an optical microscope at ×200. On the obtained micrograph, five lines, each corresponding to 600 μm, are drawn to equally divide the image into six, and the number of grain boundaries crossing each line is counted. The length 600 μm of each line divided by the obtained number of grain boundaries is calculated for each line, and an average of the obtained values is taken as the average crystal grain size.

The Mg—Li alloy according to the present invention has a tensile strength of not lower than 150 MPa, or a Vickers hardness of not lower than 50. The upper limits of these parameters are not particularly limited, but in order not to lower cold workability, the tensile strength is usually not higher than 220 MPa, preferably not higher than 180 MPa, and the Vickers hardness is usually not higher than 80, preferably not higher than 70.

The tensile strength as referred to herein may be determined by cutting out, from the Mg—Li alloy of the present invention in the form of a plate, three JIS No. 5 test pieces of 1 mm thick along each line at 0°, 45°, and 90° with respect to an arbitrarily-selected direction, and measuring the tensile strength of each test piece at 25° C. at an elastic stress rate of 10 mm/min. An average value for the test pieces of each of 0°, 45°, and 90° is calculated, and the largest of the average values is taken as the tensile strength.

The Vickers hardness as referred to herein is determined in accordance with JIS Z 2244 by making measurements at arbitrary ten points at 25° C. with the 100 gram-weight load, and taking the average as the Vickers hardness.

The inventors of the present invention have found out that corrosion resistance of the single β phase Mg—Li alloy having the Li and Al contents mentioned above, such as LA141, which has been reported to have poor corrosion resistance, is significantly improved while good cold workability is maintained, when the average crystal grain size and the tensile strength or the Vickers hardness of the alloy fulfill the above-mentioned relationship. The corrosion resistance of a preferred embodiment of the Mg—Li alloy of the present invention surpasses that of an industrially-available plate material, AZ31, without lithium, which is one of the causes of corrosion. Though various single β phase Mg—Li alloys containing Li and Al have been reported over years with little of them having been put into practical use due to their low corrosion resistance, the Mg—Li alloy of the present invention is industrially practical. For example, the above-mentioned AZ31, which is in practical use, requires warm pressing at about 250° C. for processing, whereas the Mg—Li alloy of the present invention has excellent cold workability and corrosion resistance comparable or superior to that of AZ31 at the same time, so that the present alloy may be expected to have broad range of utility.

The mechanical strength of a single β phase Mg—Li alloy containing Al, such as the Mg—Li alloy of the present invention, is not decided necessarily from its composition and average crystal grain size. For example, by rolling a cast slab of the Mg—Li alloy of the present invention at above a particular reduction to give plastic strain, and annealing the rolled alloy in a particular temperature range to recrystalize and give recrystallization texture, high tensile strength and/or high Vickers hardness that have ever been achieved, may be given to the alloy, while the average crystal grain size of the alloy is not larger than 40 μm.

On the other hand, the alloy disclosed in Example 6 of Patent Publication 4, which is produced by a method similar to that of the present invention, including hot rolling, cold rolling, and heat treatment, and has a composition and an average crystal grain size similar to those of the Mg—Li alloy of the present invention, has a tensile strength of as low as 127 MPa, and is extremely inferior in corrosion resistance as will be discussed in Comparative Example 1 below, and is of little practicability.

As disclosed in Patent Publication 4, with Mg—Li alloys, good rolled materials cannot be obtained with a larger average crystal grain size. This publication teaches that the heat treatment in the recrystallization step (annealing), which causes crystal grain growth, cannot be done over 150° C. Such a conventional recognition is assumed to have prevented for years the single β phase Mg—Li alloys from being put into practical use.

The present inventors have found out that, when a single β phase Mg—Li alloy containing Al which has been subjected to a particular higher rolling reduction in cold plastic working, such as cold rolling, is recrystallized in the annealing step in a particular higher temperature range which has conventionally been recognized to lower the properties of the alloy, the alloy is given an average crystal grain size of not smaller than 5 μm and not larger than 40 μm, and a tensile strength of not lower than 150 MPa or a Vickers hardness of not lower than 50, which have never been achieved with this composition, and that such an alloy achieves both corrosion resistance and cold workability balanced at high levels, which is of great industrial use.

The Mg—Li alloy according to the present invention may be adapted to have a surface electrical resistivity of not higher than 1Ω as measured with an ammeter by pressing against the alloy surface a cylindrical two-point probe with a pin-to-pin spacing of 10 mm and the pin tip diameter of 2 mm (contact surface area of one pin is 3.14 $mm^2$) at a load of 240 g. Further, the alloy may be adapted to have a surface electrical resistivity of not higher than 10Ω, or even not higher than 1Ω under preferred conditions, as measured with an ammeter by pressing against the alloy surface the probe at a load of 60 g. The 240 g load is an expected fixing strength when the Mg—Li alloy provides ground by means of screw fixing, and the 60 g load by means of fixing with tapes on its surface. With such a surface electrical resistivity, the Mg—Li alloy of the present invention may suitably be used for the casing parts of electronic devices wherein the substrates need to be grounded to the casing.

The method for producing the Mg—Li alloy according to the present invention is not particularly limited as long as the Mg—Li alloy of the present invention having the composition and the properties mentioned above may be obtained, and may preferably be the following production method according to the present invention.

The method according to the present invention includes the steps of:

(a) cooling and solidifying a raw material alloy melt into an alloy ingot, said alloy melt comprising not less than 10.5 mass % and not more than 16.0 mass % of Li, not less than 0.50 mass % and not more than 1.50 mass % of Al, and the balance of Mg, (b) subjecting the alloy ingot to cold plastic working at a rolling reduction of not lower than 30%, (c) annealing the processed alloy at 170° C. to lower than 250° C. for 10 minutes to 12 hours or at 250° C. to 300° C. for 10 seconds to 30 minutes, and optionally, (d) treating the surface of the obtained alloy with an electrical resistance-lowering solution, which is an inorganic acid containing aluminum and zinc metal ions, and (e) after surface conditioning, immersing the alloy into a chemical conversion-coating solution containing a fluorine compound for chemical conversion coating.

In step (a), first, metals or master alloys containing Mg, Li, Al, and the above-mentioned optional elements, such as Ca, as desired, are mixed into the above-mentioned composition to provide a raw material. Then the raw material is melted under heating to obtain a raw material alloy melt, which is then cast into a mold and cooled to solidify. It is also preferable that the raw material alloy melt may alternatively be cooled and solidified by continuous casting, such as strip casting.

The alloy ingot (slab) obtained in step (a) may usually be about 10 to 300 mm thick.

The method of the present invention includes step (b) of subjecting the alloy ingot obtained in step (a) to cold plastic working at a rolling reduction of not lower than 30%.

In step (b), the plastic working may be carried out by a known method, such as rolling, forging, extruding, or drawing, to give strain to the alloy. Here, the temperature is usually from room temperature to about 150° C. It is preferred to carryout the process at room temperature or at as low a temperature as possible for giving great strain to the alloy.

The rolling reduction in the plastic working is preferably not lower than 40%, more preferably not lower than 45%, most preferably not lower than 90%, and the maximum reduction is not particularly limited. If the alloy is processed at a rolling reduction of lower than 30%, the next step (c) of annealing the alloy so as to give a tensile strength of not lower than 150 MPa or a Vickers hardness of not lower than 50, will result in an increased average crystal grain size of the recrystallized grain, as is conventionally recognized, and the desired effect cannot be obtained.

The method of the present invention includes step (c) of annealing the alloy, which has been subjected to cold plastic working, at 170 to lower than 250° C. for 10 minutes to 12 hours, or at 250 to 300° C. for 10 seconds to 30 minutes.

In step (c), the alloy, which has been given more than a certain degree of strain in step (b), is recrystallized. The annealing may preferably be carried out at 190 to 240° C. for 30 minutes to 4 hours, or at 250 to 300° C. for 30 seconds to 10 minutes.

With the annealing conditions outside the range of 170 to lower than 250° C. for 10 minutes to 12 hours or 250 to 300° C. for 10 seconds to 30 minutes, corrosion resistance and cold workability are poor, and the objective Mg—Li alloy of practical utility cannot be obtained.

The method of the present invention may optionally include, before step (b), step (a1) of homogenizing under heating the alloy ingot obtained in step (a). The heating in step (a1) may be carried out usually at 200 to 300° C. for 1 to 24 hours.

The method of the present invention may optionally include, before step (b), further step (a2) of hot rolling the alloy ingot obtained in step (a) or (a1).

The hot rolling in step (a2) may be carried out usually at 200 to 400° C.

The Mg—Li alloy thus obtained may be subjected to degreasing, washing with water, or the like, as desired, for removal of surface oxide layers or segregation layers, as is done in ordinary chemical conversion coating.

The degreasing may be carried out by, for example, immersion in a strong alkaline solution, such as sodium hydroxide. When sodium hydroxide is used, it is prepared as a preferably 1 to 20 mass %, strong alkaline solution. The duration of immersion in a strong alkaline solution is preferably 1 to 10 minutes. Use of a sodium hydroxide aqueous solution of less than 1 mass %, or immersion for less than 1 minute, will result in insufficient degreasing, which causes poor appearance. Use of a sodium hydroxide aqueous solution of more than 20 mass % will cause generation of white powders due to residual alkali. When a strong alkaline solution other than the above-mentioned sodium hydroxide aqueous solution is used, the free alkali level (FAL) of the solution is preferably adjusted to 21.0 to 24.0 points.

Step (d) is carried out by immersing the Mg—Li alloy in an electrical resistance-lowering solution, which is an aqueous solution prepared by adding two kinds of metal ions (aluminum and zinc) to one or a mixture of two or more inorganic acids (phosphoric, nitric, sulfuric, hydrochloric, hydrofluoric, and the like acids). By the immersion treatment in this electrical resistance-lowering solution, a Mg—Li alloy with a low surface electrical resistivity may be obtained, which has never been obtained by the conventional methods. Addition of only one of aluminum and zinc alone cannot lower the surface electrical resistivity, and the effect is achieved only by addition of both elements.

The source of aluminum may be a water-soluble aluminum salt, such as aluminum nitrate, aluminum sulfate, or monobasic aluminum phosphate. The aluminum content of the lowering solution is preferably 0.021 to 0.47 g/l, more preferably 0.085 to 0.34 g/l. At lower than 0.021 g/l or over 0.47 g/l, the surface electrical resistivity cannot be lowered.

The source of zinc may be a water-soluble zinc salt, such as zinc nitrate, zinc sulfate, or zinc chloride. The zinc content of the lowering solution is preferably 0.0004 to 0.029 g/l, more preferably 0.0012 to 0.013 g/l. At less than 0.0004 g/l, the surface electrical resistivity cannot be lowered, whereas at over 0.029 g/l, the surface electrical resistivity cannot be lowered and the corrosion resistance of the coating becomes poor.

The concentration of the inorganic acid is adjusted so that the free acidity (FA) falls within the range of 9.0 to 12.0 points. A free acidity of less than 9.0 points may cause problems, such as insufficient treatment, poor appearance, increase in surface electrical resistivity, and degradation of coating adhesion, whereas a free acidity of over 12.0 points may cause problems, such as roughened surface due to excessive treatment, dimensional errors, and inferior corrosion resistance of the coating.

The immersion in the electrical resistance-lowering solution in step (d) is preferably carried out under the temperature conditions of 35° C. to 70° C., more preferably 55° C. to 65° C. Immersion at lower than 35° C. may cause problems, such as insufficient treatment, poor appearance, increase in surface electrical resistivity, and degradation of coating adhesion, whereas immersion at over 70° C. may cause problems, such as roughened surface due to excessive treatment, dimensional errors, and inferior corrosion resistance of the coating. The duration of immersion is 0.5 to 2 minutes, more preferably 1 minute. Immersion for less than 0.5 minute may cause insufficient treatment, increase in surface electrical resistivity, degradation of coating adhesion, and the like, whereas immersion for over 2 minutes may impair the corrosion resistance of the coating.

After step (d) for lowering the surface electrical resistivity with the electrical resistance-lowering solution having the composition discussed above following the degreasing with an alkaline aqueous solution, surface conditioning with an alkaline aqueous solution is carried out once again for desmutting. The surface conditioning with an alkaline aqueous solution may be carried out in a similar way as degreasing, i.e., by immersion in a strong alkaline solution, such as sodium hydroxide. When sodium hydroxide is used, it is prepared as a preferably 5 to 30 mass %, strong alkaline solution. The duration of immersion in a strong alkaline solution is preferably 0.5 to 10 minutes. The immersion temperature is 45 to 70° C. Immersion in a sodium hydroxide aqueous solution at less than 5 mass %, for less than 0.5 minute, or at lower than 45° C. may result in deterioration of corrosion resistance of the coating due to residual smut. Immersion in an over 30 mass % sodium hydroxide aqueous solution may cause generation of white powders due to residual alkali. When a strong alkaline solution other than the above-mentioned sodium hydroxide aqueous solution is used, the free alkali level (FAL) of the solution is preferably adjusted to 31.5 to 35.5 points.

Following this surface conditioning, step (e) of chemical conversion coating with a chemical conversion-coating solution containing a fluorine compound, may be carried out. Through this step (e), corrosion resistance is enhanced.

Step (e) of chemical conversion coating may be carried out by immersion in a treatment solution containing fluorine.

The source of fluorine in the chemical conversion-coating solution may preferably be at least one of hydrofluoric acid, sodium fluoride, hydrofluoric acid, bifluoride sodium, bifluoride potassium, bifluoride ammonium, hydrofluorosilicic acid and salts thereof, hydrofluoroboronic acid and salts thereof. Using these compounds, a solution with sufficient amount of fluorine dissolved in an active state may be obtained.

The fluorine content of the chemical conversion-coating solution is preferably 3.33 to 40 g/l, more preferably 8.0 to 30.0 g/l. Coating with a solution with less than 3.33 g/l fluorine may result in insufficient amount of coating, deterioration of corrosion resistance of the coating, and the like, whereas with over 40 g/l fluorine, increase in surface electrical resistivity, degradation of coating adhesion, and the like.

The acid concentration of the chemical conversion-coating solution is adjusted so that the free acidity (FA) falls within the range of 8.0 to 12.0 points. A free acidity of less than 8.0 points may cause insufficient amount of coating, deterioration of corrosion resistance of the coating, and the like, whereas a free acidity of over 12.0 points may cause increase in surface electrical resistivity, degradation of coating adhesion, and the like.

The chemical conversion coating with a chemical conversion-coating solution may be carried out by a common method which allows the coating solution in contact with the surface of the Mg—Li alloy for a certain period of time, such as by immersing the Mg—Li alloy in the chemical conversion-coating solution.

When the coating is carried out by immersion as mentioned above, the chemical conversion-coating solution may preferably be under the temperature conditions of 40 to 80° C., more preferably about 55 to 65° C. for quick and good chemical reaction of magnesium and lithium with fluorine. The duration of immersion is preferably 0.5 to 5 minutes, more preferably about 1.5 to 4.5 minutes for generation of magnesium fluoride and lithium fluoride on the surface of the Mg—Li alloy, and for sufficient expression of their composite action. Immersion for less than 0.5 minute may result in insufficient amount of coating, deterioration of corrosion resistance of the coating, and the like, whereas for over 5 minutes, increase in surface electrical resistivity and degradation of coating adhesion due to excessive treatment.

The surface treatment of the Mg—Li alloy of the present invention after step (c) may preferably include the degreasing, step (d), and the surface adjustment followed by step (e). Here, the degreasing, step (d), and the surface adjustment followed by step (e) are carried out independently, with washing with water between the successive steps.

The Mg—Li alloy thus obtained through the method of the present invention, when provided with surface coating, may maintain excellent corrosion resistance with the coating film. This coating process may be performed after the surface adjustment according to the present invention mentioned above and the subsequent washing with water and drying. The coating may be formed, for example, by primer treatment by cationic electrodeposition painting of epoxy, top coating treatment with a melamine resin, and typical baking finishing.

Further, the coating process may be carried out by a conventional method, such as electrodeposition, spray painting, or dip coating, using for example, a conventional organic or inorganic coating material.

Instead of the coating process, anodizing followed by FPF (Finger Print Free) coating (glass coating), which is typically employed for titanium alloys, may be performed. This results in formation of an excellent coating film with high adhesion and high density.

In addition, heat treatment may suitably be added before and/or after the surface treatment.

The Mg—Li alloy obtained by the method of the present invention, which has excellent corrosion resistance and may be given a low surface electrical resistivity, may effectively be used for the casing parts of various electrical instrument, such as mobile phones, notebook PCs, portable translators, video cameras, and digital cameras, which are required to have a low surface electrical resistivity for good electromagnetic shielding ability and for providing ground to the substrates.

Further, the Mg—Li alloy obtained by the method of the present invention is capable of maintaining excellent corrosion resistance even in the form of an as-rolled material or after the rolled material is processed by, e.g., pressing.

The surface treatment after step (c) may be performed on the Mg—Li alloy pressed into a formed article, or on the Mg—Li alloy as rolled before working.

The rolled material according to the present invention, which is made of the Mg—Li alloy of the present invention, has excellent corrosion resistance and cold workability. The thickness of the rolled material is usually about 0.01 to 5 mm.

The rolled material of the present invention may be made into a formed article, such as casing parts of portable audiovisual apparatus, digital cameras, mobile phones, and notebook PCs, or automotive parts, by, for example, cold pressing.

The rolled material of the present invention, which has excellent cold workability, provides high dimensional precision without cracking or poor appearance, and improves productivity of the formed articles mentioned above and the like.

The formed article according to the present invention, which is made of the Mg—Li alloy of the present invention, has excellent corrosion resistance.

The formed article of the present invention may be obtained by forming the Mg—Li alloy of the present invention through, for example, cutting, grinding, polishing, pressing, and the like process. In view of the facility and production costs, the formed article of the present invention is preferably produced from a rolled material of the present invention by cold pressing.

The Mg—Li alloy obtained through all the steps discussed above may be given a surface electrical resistivity of not higher than 1Ω as measured with an ammeter by pressing against the alloy surface an A-probe (manufactured by MITSUBISHI CHEMICAL ANALYTECH CO., LTD.), which is a cylindrical two-point probe with a pin-to-pin spacing of 10 mm and the pin tip diameter of 2 mm (contact surface area of one pin is 3.14 $mm^2$) at a load of 240 g. Thus such Mg—Li alloy may suitably be used for casing parts of electronic devices in which the substrates need to be grounded to the casing, or which are required to have electromagnetic shielding ability.

EXAMPLES

The present invention will now be explained in more detail with reference to Examples, which are not intended to limit the present invention.

Example 1

A raw material having a composition of 14.0 mass % Li, 1.00 mass % Al, 0.30 mass % Ca, and the balance of Mg, was heated to melt into an alloy melt. The alloy melt was cast into a metal mold of 55 mm×300 mm×500 mm to prepare an alloy ingot. The composition of the obtained alloy was determined by the ICP atomic emission spectrochemical analysis. The results are shown in Table 1.

The alloy ingot thus obtained was heat treated at 300° C. for 24 hours and the surface was cut to prepare a slab of 50 mm thick for rolling. This slab was rolled at 350° C. into aboard thickness of 2 mm, and then at room temperature into a board thickness of 1 mm at a rolling reduction of 50%, to thereby obtain a rolled product. The rolled product was annealed at 230° C. for 1 hour to produce a rolled material.

The average crystal grain size, the tensile strength, and the Vickers hardness of the rolled material thus obtained were measured according to the methods discussed above. Corrosion resistance was evaluated by a 5% salt water immersion test, and cold workability was evaluated by determining the limiting drawing ratio (LDR) at room temperature. The results are shown in Table 1.

The 5% salt water immersion test was performed by repeating three cycles of the steps of immersing a test piece, which had been surface polished and washed with acetone, in a salt water containing 5% sodium chloride at a solution temperature of 25±5° C. for 8 hours, and leaving the test piece in the air for 16 hours. The evaluation was made by determining the mass change per unit surface area as a degree of corrosion, and calculating a ratio of the degree with respect to the degree of corrosion of AZ31 material, which was tested in parallel as a comparison, being 100.

The conditions for determining the LDR were as follows: punch diameter: 40 mm; die diameter: 42.5 mm; die shoulder radius: 8 mm; fold pressure: 12 kN; punch shoulder radius: 4 mm; lubricant: molybdenum disulfide; punch speed: 3 mm/sec.

Comparative Example 1

A rolled material was prepared and evaluated in the same way as in Example 1, except that the composition of the raw material was 14.0 mass % Li, 1.00 mass % Al, and the balance of Mg, and the annealing at 230° C. for 1 hour was changed to at 150° C. for 1 hour. The results are shown in Table 2.

Examples 2 to 16 and Comparative Examples 2 to 11

A rolled material was prepared in the same way as in Example 1, except that the composition of the raw material was changed as shown in Tables 1 and 2, and the production conditions were changed as shown in Tables 1 and 2. The obtained rolled material was evaluated in the same way as in Example 1. The results of Examples are shown in Table 1, and those of Comparative Examples in Table 2.

TABLE 1

| Ex. | Board thickness after hot rolling (mm) | Cold rolling reduction (%) | Board thickness after cold rolling (mm) | Annealing Temp. (° C.) | Annealing Time (hr) | Alloy composition (mass %) Li | Al | Ca | Other than Li, Al, Ca, and Mg | Mg | Average crystal grain size (μm) | Tensile strength (MPa) | Vickers hardness (Hv) | Degree of Corrosion (5% salt water immersion test) | LDR |
|---|---|---|---|---|---|---|---|---|---|---|---|---|---|---|---|
| 1 | 2.0 | 50 | 1.0 | 230 | 1 | 13.7 | 1.04 | 0.26 | | Balance | 15 | 156 | 58 | 65 | 2.05 |
| 2 | 1.5 | 33 | 1.0 | 240 | 1 | 13.8 | 1.05 | 0.27 | | Balance | 18 | 175 | 64 | 71 | 2.05 |
| 3 | 4.0 | 75 | 1.0 | 240 | 10 | 13.6 | 1.03 | 0.30 | | Balance | 35 | 185 | 72 | 101 | 2.00 |
| 4 | 2.0 | 50 | 1.0 | 240 | 5 | 13.8 | 1.03 | 0.30 | | Balance | 38 | 152 | 57 | 121 | 2.00 |
| 5 | 2.0 | 50 | 1.0 | 220 | 1 | 12.1 | 1.02 | 0.28 | | Balance | 16 | 161 | 60 | 63 | 1.70 |
| 6 | 2.0 | 50 | 1.0 | 220 | 1 | 13.2 | 0.99 | 0.32 | | Balance | 18 | 159 | 59 | 66 | 1.95 |
| 7 | 2.0 | 50 | 1.0 | 220 | 1 | 14.8 | 0.97 | 0.31 | | Balance | 33 | 161 | 60 | 97 | 1.90 |
| 8 | 2.0 | 50 | 1.0 | 220 | 1 | 15.5 | 1.05 | 0.25 | | Balance | 35 | 151 | 56 | 215 | 2.15 |
| 9 | 2.0 | 50 | 1.0 | 230 | 1 | 13.7 | 1.04 | 0.00 | | Balance | 40 | 181 | 68 | 156 | 2.00 |
| 10 | 2.0 | 50 | 1.0 | 220 | 1 | 13.1 | 0.89 | 0.20 | Zn 1.20 | Balance | 37 | 151 | 55 | 105 | 2.05 |
| 11 | 2.0 | 50 | 1.0 | 220 | 1 | 13.4 | 0.97 | 0.15 | Mn 0.35 | Balance | 20 | 173 | 63 | 61 | 1.90 |
| 12 | 2.0 | 50 | 1.0 | 220 | 1 | 12.5 | 0.95 | 0.10 | Ce 1.53 | Balance | 25 | 165 | 61 | 62 | 1.85 |
| 13 | 2.0 | 50 | 1.0 | 220 | 1 | 12.3 | 0.81 | 0.13 | Y 0.51 | Balance | 18 | 166 | 61 | 63 | 1.90 |
| 14 | 20.0 | 95 | 1.0 | 180 | 1 | 13.7 | 0.97 | 0.23 | | Balance | 19 | 165 | 60 | 91 | 2.05 |
| 15 | 10.0 | 90 | 1.0 | 200 | 1 | 13.4 | 0.96 | 0.29 | | Balance | 17 | 157 | 58 | 66 | 2.05 |
| 16 | 20.0 | 95 | 1.0 | 200 | 1 | 13.7 | 1.04 | 0.00 | | Balance | 23 | 159 | 59 | 83 | 2.05 |

TABLE 2

| Comp. Ex. | Board thickness after hot rolling (mm) | Cold rolling reduction (%) | Board thickness after cold rolling (mm) | Annealing Temp. (° C.) | Annealing Time (hr) | Alloy composition (mass %) Li | Al | Ca | Mg | Average crystal grain size (μm) | Tensile strength (MPa) | Vickers hardness (Hv) | Degree of Corrosion (5% salt water immersion test) | LDR |
|---|---|---|---|---|---|---|---|---|---|---|---|---|---|---|
| 1 | 2.0 | 50 | 1.0 | 150 | 1 | 13.5 | 1.04 | 0.00 | Balance | 25 | 131 | 46 | 1577 | 1.95 |
| 2 | 2.0 | 50 | 1.0 | 260 | 1 | 13.7 | 0.98 | 0.00 | Balance | 51 | 161 | 60 | 317 | 1.95 |
| 3 | 2.0 | 50 | 1.0 | 230 | 1 | 13.9 | 0.00 | 0.00 | Balance | 39 | 101 | 36 | 2652 | 2.10 |
| 4 | 2.0 | 50 | 1.0 | 230 | 1 | 13.7 | 2.10 | 0.00 | Balance | 38 | 174 | 64 | 81 | 1.50 |
| 5 | 2.0 | 50 | 1.0 | 220 | 1 | 10.2 | 1.05 | 0.00 | Balance | 18 | 174 | 64 | 64 | 1.40 |
| 6 | 2.0 | 50 | 1.0 | 230 | 1 | 16.5 | 1.04 | 0.00 | Balance | 40 | 131 | 47 | 510 | 2.20 |
| 7 | 2.0 | 50 | 1.0 | 130 | 1 | 13.6 | 1.00 | 0.26 | Balance | — | 232 | 72 | 2781 | 1.65 |
| 8 | 1.3 | 23 | 1.0 | 160 | 1 | 13.3 | 0.95 | 0.00 | Balance | — | 185 | 68 | 2472 | 1.60 |
| 9 | 1.3 | 23 | 1.0 | 250 | 1 | 13.3 | 0.95 | 0.00 | Balance | 51 | 159 | 59 | 334 | 1.95 |

TABLE 2-continued

| Comp. Ex. | Board thickness after hot rolling (mm) | Cold rolling reduction (%) | Board thickness after cold rolling (mm) | Annealing Temp. (° C.) | Annealing Time (hr) | Alloy composition (mass %) Li | Al | Ca | Mg | Average crystal grain size (μm) | Tensile strength (MPa) | Vickers hardness (Hv) | Degree of Corrosion (5% salt water immersion test) | LDR |
|---|---|---|---|---|---|---|---|---|---|---|---|---|---|---|
| 10 | 20.0 | 95 | 1.0 | 160 | 1 | 13.7 | 0.97 | 0.00 | Balance | 21 | 141 | 49 | 1375 | 1.90 |
| 11 | 20.0 | 95 | 1.0 | 260 | 1 | 13.7 | 0.97 | 0.00 | Balance | 59 | 165 | 61 | 317 | 1.70 |

As can be seen from the results shown in Table 1, when all of the cold rolling reduction, the annealing temperature, and the alloy composition were within the ranges defined in the production method according to the present invention, the average crystal grain size, the tensile strength, and the Vickers hardness fall within the ranges defined for the Mg—Li alloy according to the present invention, and excellent corrosion resistance and cold workability (results of LDR) were achieved.

As can be seen from the results shown in Table 2, in Comparative Examples 1 and 2, only the temperature or duration of annealing was outside the range defined in the production method according to the present invention, which resulted in good cold workability but poor corrosion resistance. In Comparative Example 2, though the alloy composition, the tensile strength, and the Vickers hardness were within the ranges defined for the Mg—Li alloy of the present invention, the average crystal grain size was too large, and thus the desired properties could not be obtained.

Comparative Example 3 demonstrates that absence of Al in the alloy composition alone resulted in inferior corrosion resistance.

Comparative Examples 4 and 5 demonstrate that only the alloy composition with too high an Al content or too low a Li content being outside the range defined in the production method of the present invention, the cold workability was significantly poor, while the tensile strength, the Vickers hardness, and the average crystal grain size were within the ranges defined for the Mg—Li alloy of the present invention.

Comparative Example 6 demonstrates that only the alloy composition of too high a Li content being outside the range defined in the production method of the present invention, the corrosion resistance was poor.

Comparative Example 7 demonstrates that only the annealing temperature of 130° C. for 1 hour being lower than the range defined in the production method of the present invention, recrystallization did not occur, and the cold workability and the corrosion resistance were both inferior, while the tensile strength and the Vickers hardness fall within the ranges defined for the Mg—Li alloy of the present invention.

Comparative Example 8 demonstrates that the cold rolling reduction and the annealing temperature being outside the ranges defined in the production method of the present invention, recrystallization did not occur, and the cold workability and the corrosion resistance were both inferior, while the tensile strength and the Vickers hardness fall within the ranges defined for the Mg—Li alloy of the present invention.

Comparative Example 9 demonstrates that the cold rolling reduction being outside the range defined in the production method of the present invention, the average crystal grain size was too large, and the corrosion resistance was poor, while the tensile strength and the Vickers hardness fall within the ranges defined for the Mg—Li alloy of the present invention.

Comparative Example 10 demonstrates that even with a high cold rolling reduction, when the annealing temperature of 160° C. for 1 hour was lower than the range defined in the production method of the present invention, the tensile strength and the Vickers hardness did not fall within the ranges defined for the Mg—Li alloy of the present invention, and the corrosion resistance was poor, while recrystallization occurred.

Comparative Example 11 demonstrates that even with a high cold rolling reduction, when the annealing temperature of 260° C. for 1 hour was outside the range defined in the production method of the present invention, the average crystal grain size was too large and the corrosion resistance was poor, while the tensile strength and the Vickers hardness fall within the ranges defined for the Mg—Li alloy of the present invention.

What is claimed is:

1. A magnesium-lithium alloy comprising
- not less than 10.5 mass % and not more than 16.0 mass % Li,
- not less than 0.50 mass % and not more than 1.50 mass % Al,
- not less than 0.10 mass % and not more than 0.50 mass % Ca, and
- the balance of Mg,
- wherein said alloy does not comprise more than 0.005 mass % of Cu, and
- wherein said alloy has an average crystal grain size of not smaller than 5 μm and not larger than 40 μm, and a tensile strength of not lower than 150 MPa.

2. The magnesium-lithium alloy according to claim 1, wherein said average crystal grain size is not smaller than 5 μm and not larger than 20 and said tensile strength is not lower than 150 MPa and not higher than 180 MPa.

3. A magnesium-lithium alloy comprising
- not less than 10.5 mass % and not more than 16.0 mass % Li,
- not less than 0.50 mass % and not more than 1.50 mass % Al,
- not less than 0.10 mass % and not more than 0.50 mass % Ca, and
- the balance of Mg,
- wherein said alloy does not comprise more than 0.005 mass % of Cu, and
- wherein said alloy has an average crystal grain size of not smaller than 5 μm and not larger than 40 μm, and a Vickers hardness (HV) of not lower than 50.

4. The magnesium-lithium alloy according to claim 3, wherein said average crystal grain size is not smaller than 5 μm and not larger than 20 μm, and said Vickers hardness (HV) is not lower than 50 and not higher than 70.

5. The magnesium-lithium alloy according to claim 1, wherein said content of Li is not less than 13.0 mass % and not more than 15.0 mass %.

6. A method for producing a magnesium-lithium alloy of claim 1, comprising the steps of:

(a) cooling and solidifying a raw material alloy melt into an alloy ingot, said raw material alloy melt comprising not less than 10.5 mass % and not more than 16.0 mass % Li, not less than 0.50 mass % and not more than 1.50 mass % Al, not less than 0.10 mass % and not more than 0.50 mass % Ca, and the balance of Mg, said raw material alloy melt not comprising more than 0.005 mass % of Cu, (b) subjecting said alloy ingot to cold plastic working at a rolling reduction of not lower than 30%, and (c) annealing a plastic-processed alloy at 170 to lower than 250° C. for 10 minutes to 12 hours, or at 250 to 300° C. for 10 seconds to 30 minutes.

7. The method according to claim 6, further comprising, before step (b), the step of (a1) homogenizing said alloy ingot obtained in step (a).

8. The method according to claim 6, further comprising, before step (b), the step of (a2) hot rolling said alloy ingot obtained in step (a) or (a1).

9. A rolled material made of a magnesium-lithium alloy according to claim 1.

10. A formed article made of a magnesium-lithium alloy according to claim 1.

* * * * *